US007936322B2

(12) United States Patent
Chung et al.

(10) Patent No.: US 7,936,322 B2
(45) **Date of Patent: *May 3, 2011**

(54) PIXEL AND ORGANIC LIGHT EMITTING DISPLAY DEVICE USING THE SAME

(75) Inventors: Bo-Yong Chung, Yongin (KR); Keum-Nam Kim, Yongin (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 0 days.

This patent is subject to a terminal disclaimer.

(21) Appl. No.: 12/615,204

(22) Filed: Nov. 9, 2009

(65) Prior Publication Data

US 2010/0220086 A1 Sep. 2, 2010

(30) Foreign Application Priority Data

Feb. 27, 2009 (KR) ..... 10-2009-0016732

(51) Int. Cl.
*G09G 3/32* (2006.01)

(52) U.S. Cl. ..... 345/82; 345/76

(58) Field of Classification Search ..... 345/82, 345/83, 76–80; 315/169.1–169.4
See application file for complete search history.

(56) References Cited

FOREIGN PATENT DOCUMENTS

KR 10-2008-0000468 1/2008
KR 10-2008-0067856 7/2008

*Primary Examiner* — Ricardo L Osorio
(74) *Attorney, Agent, or Firm* — Christie, Parker & Hale, LLP

(57) ABSTRACT

A pixel configured to compensate for a threshold voltage of a driving transistor and including an organic light emitting diode coupled between a first power supply and a second power supply; a first transistor coupled between the organic light emitting diode and the second power supply and having a gate electrode coupled to a first node; a second transistor coupled between the first transistor and a data line and having a gate electrode coupled to a scan line; a third transistor coupled between the first transistor and the first node and having a gate electrode coupled to the scan line; a fourth transistor coupled between the first transistor and the second power supply and having a gate electrode coupled to an emission control line; and a fifth transistor coupled between the organic light emitting diode and the first transistor and having a gate electrode coupled to the emission control line.

17 Claims, 2 Drawing Sheets

PIXEL AND ORGANIC LIGHT EMITTING DISPLAY DEVICE USING THE SAME

CROSS-REFERENCE TO RELATED APPLICATION

This application claims priority to and the benefit of Korean Patent Application No. 10-2009-0016732, filed on Feb. 27, 2009 in the Korean Intellectual Property Office, the entire content of which is incorporated herein by reference.

BACKGROUND

1. Field

Embodiments of the present invention relate to a pixel that is capable of compensating for the threshold voltage of a driving transistor, and an organic light emitting display device using the same.

2. Description of the Related Art

Recently, various flat panel display devices having smaller weight and volume than a cathode ray tube have been developed. Such flat panel display devices include liquid crystal display devices, field emission display devices, plasma display panels, organic light emitting display devices, and others.

Among others, the organic light emitting display device displays an image using organic light emitting diodes that generate light by recombination of electrons and holes. Such an organic light emitting display device is driven with low power consumption and has a fast response time.

Generally, the organic light emitting display device represents gray levels, while controlling the amount of current flowing to the organic light emitting diodes using a driving transistor included in each of a plurality of pixels. In this case, an image having uneven brightness may be displayed by variations in threshold voltage amongst driving transistors included in the pixels.

SUMMARY

Embodiments of the present invention provide a pixel configured to compensate for a threshold voltage of a driving transistor, and further embodiments of the present invention provide an organic light emitting display device using the same.

According to an embodiment of the present invention, a pixel includes: an organic light emitting diode coupled between a first power supply and a second power supply having a lower voltage than the first power supply; a first transistor coupled between the organic light emitting diode and the second power supply and having a gate electrode coupled to a first node; a second transistor coupled between a first electrode of the first transistor and a data line and having a gate electrode coupled to a scan line; a third transistor coupled between a second electrode of the first transistor and the first node and having a gate electrode coupled to the scan line; a fourth transistor coupled between the first transistor and the second power supply and having a gate electrode coupled to an emission control line; a fifth transistor coupled between the organic light emitting diode and the first transistor and having a gate electrode coupled to the emission control line; and a capacitor coupled between the first node and the second power supply, wherein the first, second, third, fourth, and fifth transistors are N-type transistors.

In one embodiment, the pixel is configured to receive a scan signal having a high level from the scan line and an emission control signal having a high level from the emission control line during a first period of a horizontal period when the pixel is selected, the pixel is further configured to receive the scan signal having the high level and an emission control signal having a low level during a second period following the first period, and the pixel is further configured to receive the emission control signal having the high level during a third period in which a supply of the scan signal having the high level to the pixel is suspended, the third period following the second period.

In one embodiment, during the first period, the first node is initialized by a voltage transferred to the first node from the first power supply via the fifth transistor and the third transistor.

In one embodiment, during the second period, a data signal supplied from the data line is transferred to the first node through the first, second, and third transistors. In one embodiment, during the second period, the first transistor maintains a diode-coupled state by turn-on of the third transistor.

In one embodiment, during the third period, a current path through which current flows to the second power supply from the first power supply via the organic light emitting diode is formed by turn-on of the fourth and fifth transistors.

According to another embodiment of the present invention, an organic light emitting display device includes: a display unit including a plurality of pixels, each of the pixels including: an organic light emitting diode coupled between a first power supply and a second power supply having a lower voltage than the first power supply; a first transistor coupled between the organic light emitting diode and the second power supply and having a gate electrode coupled to a first node; a second transistor coupled between a first electrode of the first transistor and a data line and having a gate electrode coupled to a scan line; a third transistor coupled between a second electrode of the first transistor and the first node and having a gate electrode coupled to the scan line; a fourth transistor coupled between the first transistor and the second power supply and having a gate electrode coupled to an emission control line; a fifth transistor coupled between the organic light emitting diode and the first transistor and having a gate electrode coupled to the emission control line; and a capacitor coupled between the first node and the second power supply.

In one embodiment, the first, second, third, fourth, and fifth transistors may be N-type transistors.

In one embodiment, the organic light emitting display device further includes a scan driver configured to provide to pixels of the plurality of pixels: a scan signal having a high level and an emission control signal having a high level during a first period of a horizontal period when the pixels are selected; the scan signal having the high level and an emission control signal having a low level during a second period following the first period; and the emission control signal having the high level during a third period in which a supply of the scan signal having the high level to the pixels is suspended, the third period following the second period.

In one embodiment, the display unit includes power supply lines for supplying a second power from the second power supply, the power supply lines arranged in a mesh pattern.

According to another embodiment of the present invention, a method of controlling a pixel having an organic light emitting diode coupled between a first power supply and a second power supply having a lower voltage than the first power supply; a first transistor coupled between the organic light emitting diode and the second power supply and having a gate electrode coupled to a first node; a second transistor coupled between a first electrode of the first transistor and a data line and having a gate electrode coupled to a scan line; a third transistor coupled between a second electrode of the first transistor and the first node and having a gate electrode coupled to the scan line; a fourth transistor coupled between the first transistor and the second power supply and having a gate electrode coupled to an emission control line; a fifth transistor coupled between the organic light emitting diode and the first transistor and having a gate electrode coupled to the emission control line; and a capacitor coupled between the first node and the second power supply includes: supplying to the pixel a scan signal having a high level from the scan line and an emission control signal having a high level from the emission control line during a first period of a horizontal period when the pixel is selected; supplying to the pixel the scan signal having the high level and an emission control signal having a low level during a second period following the first period; suspending the scan signal having the high level to the pixel after the second period; and supplying to the pixel the emission control signal having the high level during a third period subsequent to suspending the supply to the pixel of the scan signal having the high level.

In one embodiment, the first node is initialized during the first period by a voltage transferred to the first node from the first power supply via the fifth transistor and the third transistor.

In one embodiment, the method further includes supplying a data signal from the data line during the second period, and the data signal is transferred to the first node through the first, second, and third transistors. In one embodiment, a diode-coupled state is maintained in the first transistor during the second period by turn-on of the third transistor.

In one embodiment, a current path through which current flows from the first power supply to the second power supply via the organic light emitting diode is formed during the third period by turn-on of the fourth and fifth transistors.

In embodiments of the pixel and the organic light emitting display device using the same according to the present invention, the pixel circuit includes relatively fewer transistors, thereby configuring the pixel to compensate for the threshold voltage of the driving transistor and further to improve the image quality and the power consumption.

BRIEF DESCRIPTION OF THE DRAWINGS

The accompanying drawings, together with the specification, illustrate exemplary embodiments of the present invention, and, together with the description, serve to explain principles of embodiments of the present invention.

DETAILED DESCRIPTION

Figure 1:
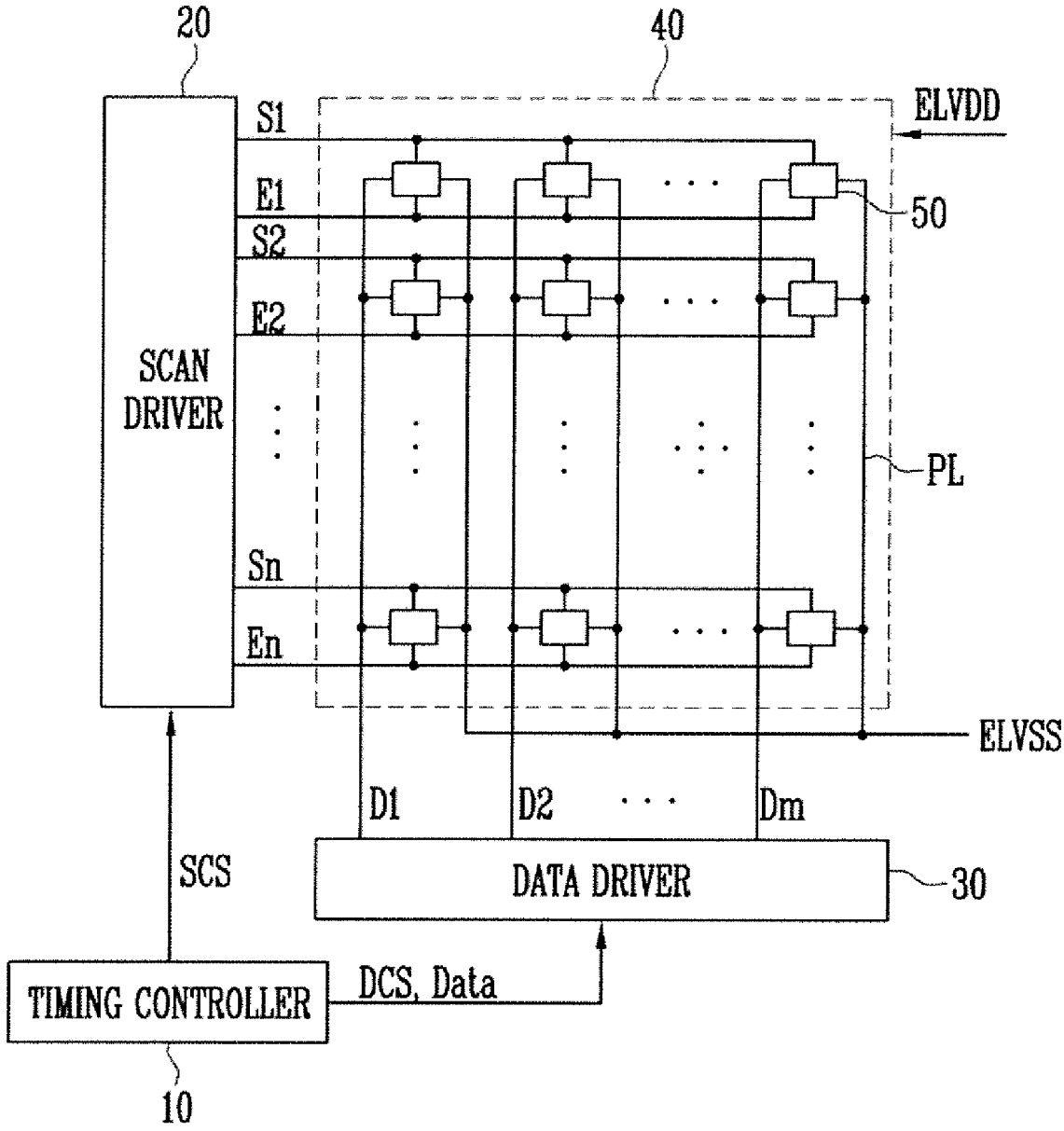
FIG. 1 is a schematic block diagram of an organic light emitting display device according to an embodiment of the present invention.

Hereinafter, certain exemplary embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to a complete understanding of the invention are omitted for clarity.

Like reference numerals are used in the description and accompanying drawings to refer to like elements throughout.

FIG. 1 is a schematic block diagram of an organic light emitting display device according to an embodiment of the present invention.

Referring to FIG. 1, an organic light emitting display device according to one embodiment of the present invention includes a timing controller 10, a scan driver 20, a data driver 30, and a display unit 40.

The timing controller 10 generates a scan driving control signal SCS and a data driving control signal DCS corresponding to externally supplied synchronization signals. The scan driving control signal SCS generated by the timing controller 10 is supplied to the scan driver 20, and the data driving control signal DCS is supplied to the data driver 30. Also, the timing controller 10 supplies externally supplied data Data to the data driver 30.

The scan driver 20 generates scan signals and emission control signals corresponding to the scan driving control signals SCS supplied from the timing controller 10, and supplies the scan signals and the emission control signals to scan lines S1 to Sn and emission control lines E1 to En, respectively. When the scan signals are supplied to the scan lines S1 to Sn, pixels 50 are selected sequentially in a row unit. If the emission control signals are supplied to the emission control lines E1 to En, the emission of the pixels 50 is controlled.

The data driver 30 generates data signals corresponding to the data driving control signals DCS and data Data supplied from the timing controller 10, and supplies the data signals to data lines D1 to Dm. The data signals supplied to the data lines D1 to Dm are transferred to the selected pixels 50 by the scan signals.

The display unit 40 is positioned at a crossing region of the scan lines S1 to Sn, the emission control lines E1 to En, and the data lines D1 to Dm, and includes the plurality of pixels 50, each of the pixels 50 including an organic light emitting diode (not shown in FIG. 1).

Each of the pixels 50 is coupled to a scan line S, an emission control line E, and a data line D positioned in a horizontal line and a vertical line where the pixel is positioned to receive a scan signal, an emission control signal, and a data signal respectively therefrom. Each of the pixels 50 emits light with a brightness corresponding to the data signal.

Also, the pixels 50 are driven by receiving driving power such as high potential pixel power ELVDD (hereinafter referred to as the first power supply) and low potential pixel power ELVSS (hereinafter referred to as the second power supply) from a power supply unit (not shown).

However, in an embodiment of the present invention, each of the pixels 50 includes a pixel circuit that is coupled between the cathode electrode of the organic light emitting diode and the second power supply ELVSS, and includes N-type transistors and a capacitor.

When the pixel circuit is coupled between the cathode electrode of the organic light emitting diode and the second power supply ELVSS and includes the N-type transistors and the capacitor as described above, the first power supply ELVDD may be supplied entirely to the display unit and the second power supply ELVSS may be supplied to the pixels 50 by power supply lines PL in a line shape. In particular, when the voltage from the second power supply ELVSS affects the emission brightness of the pixel 50, the power supply lines PL are positioned on the display unit 40 in a mesh shape, making it possible to reduce or minimize the voltage drop from the second power supply ELVSS.

A more detailed explanation of the configuration and the operation of the pixels 50 as described above will be provided later herein.

Figure 2:
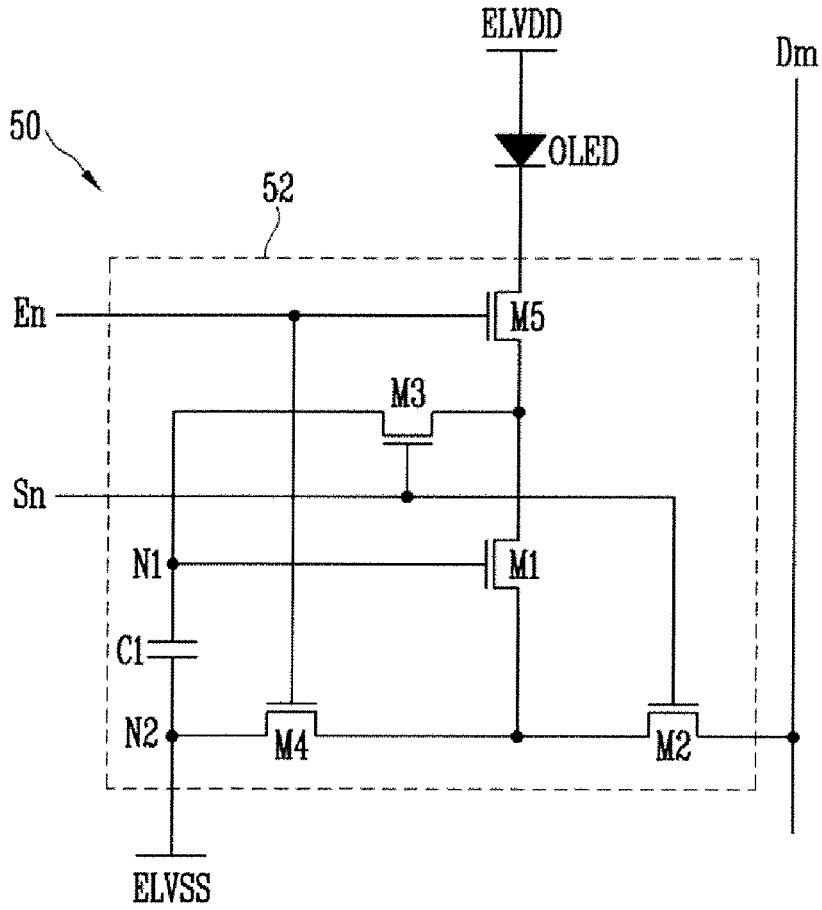
FIG. 2 is a circuit diagram showing a pixel of the organic light emitting display device of FIG. 1 according to one embodiment of the present invention.

FIG. 2 is a circuit diagram showing one embodiment of a pixel of the organic light emitting display device of FIG. 1. Referring to FIG. 2, the pixel 50 according to one embodiment of the present invention includes an organic light emitting diode OLED that generates light having brightness corresponding to driving current and a pixel circuit 52 that controls the driving current that flows in the organic light emitting diode OLED.

The organic light emitting diode OLED is coupled between the first power supply ELVDD and the second power supply ELVSS to emit light with a brightness corresponding to the driving current controlled by the pixel circuit 52.

More specifically, in one embodiment, the anode electrode of the organic light emitting diode OLED is coupled to the first power supply ELVDD, and the cathode electrode thereof is coupled to the second power supply ELVSS via the pixel circuit 52.

The pixel circuit 52 is coupled between the organic light emitting diode OLED and the second power supply ELVSS. The pixel circuit 52 as described above controls the driving current corresponding to the data signal to flow to the organic light emitting diode OLED during the emission period of the pixel 50.

In one embodiment, the pixel circuit 52 includes first to fifth transistors M1 to M5 that are implemented as N-type transistors, and a capacitor C1.

The first transistor M1 is coupled between the organic light emitting diode OLED and the second power supply ELVSS to control the amount of driving current that flows during the emission period.

To this end, in the embodiment shown in FIG. 2, the drain electrode of the first transistor M1 is coupled to the organic light emitting diode OLED via the fifth transistor M5, and the source electrode of the first transistor M1 is coupled to the second power supply ELVSS via the fourth transistor M4. The gate electrode of the first transistor M1 is coupled to a first node N1.

The first transistor M1 as described above controls the amount of driving current corresponding to the voltage from the first node N1.

The second transistor M2 is coupled between the data line Dm and one electrode (e.g., the source electrode) of the first transistor M1 to receive the data signal into the pixel 50 during a data programming period for applying the data signal to the pixel 50.

To this end, in one embodiment, the drain electrode of the second transistor M2 is coupled to the source electrode of the first transistor M1, and the source electrode of the second transistor M2 is coupled to the data line Dm. The gate electrode of the second transistor M2 is coupled the scan line Sn.

The second transistor M2 as described above is turned on during a scan period in which a scan signal having a high level is supplied from the scan line Sn to transfer the data signal supplied from the data line Dm during at least the data programming period of the scan period to the source electrode of the first transistor M1. At this time, the data signal transferred to the first transistor M1 is transferred to the first node N1 through the first transistor M1 and the third transistor M3.

The third transistor M3 is coupled between the other electrode (e.g., the drain electrode) of the first transistor M1 (the electrode opposite to the electrode to which the second transistor M2 is coupled) and the first node N1 to diode-couple the first transistor M1 during the data programming period.

To this end, in the embodiment shown in FIG. 2, the drain electrode of the third transistor M3 is coupled to the drain electrode of the first transistor M1, and the source electrode of the third transistor M3 is coupled to the first node N1 to which the gate electrode of the first transistor M1 is coupled. Here, the drain electrode and the source electrode may also be changed by the relative magnitude of the voltage applied to both electrodes. The gate electrode of the third transistor M3 is coupled to the scan line Sn.

The third transistor M3 as described above is turned on during the scan period to diode-couple the first transistor M1. Meanwhile, the third transistor M3 transfers the voltage that initializes the first node N1 to the first node N1 during an initialization period of the scan period in which the third transistor M3 is turned on together with the fifth transistor M5, prior to the programming period.

The fourth transistor M4 is coupled between the first transistor M1 and the second power supply ELVSS to allow the driving current that is controlled by the first transistor M1 to flow to the second power supply ELVSS during the emission period.

To this end, in the embodiment shown in FIG. 2, the drain electrode of the fourth transistor M4 is coupled to the source electrode of the first transistor M1 and the source electrode of the fourth transistor M4 is coupled to the second power supply ELVSS at a second node N2. The gate electrode of the fourth transistor M4 is coupled to the emission control line En.

The fourth transistor M4 as described above maintains a turn-off state during a period in which the emission control signal having a low level is supplied to the emission control line En and is turned on during an emission period in which the voltage level of the emission control signal is transitioned to a high level to form a current path.

The fifth transistor M5 is coupled between the organic light emitting diode OLED and the first transistor M1 to form the current path through which the driving current flows during the emission period.

To this end, in the embodiment shown in FIG. 2, the drain electrode of the fifth transistor M5 is coupled to the cathode electrode of the organic light emitting diode OLED and the source electrode of the fifth transistor M5 is coupled to the drain electrode of the first transistor M1. The gate electrode of the fifth transistor M5 is coupled to the emission control line En.

The fifth transistor M5 as described above maintains a turn-off state during the period in which the emission control signal having a low level is supplied to the emission control line En and is turned on during the emission period in which the voltage level of the emission control signal is transitioned to a high level to form a current path through which the driving current flows. The fifth transistor M5 is also turned on during the initialization period of the scan period, prior to the data programming period, so that the voltage that initializes the first node N1 is transferred to the first node N1 from the first power supply ELVDD. A more detailed description thereof will be provided later herein.

The capacitor C1 is coupled between the first node N1 and the second node N2 to charge a voltage corresponding to the data signal supplied during the data programming period and the threshold voltage of the first transistor M1.

Hereinafter, the operation of the pixel 50 of FIG. 2 will be described in further detail, together with a waveform view of FIG. 3 that shows a waveform of an input signal input to the pixel 50 of FIG. 2. For convenience, FIG. 3 will be described in relation to the waveform of the scan signal and the emission control signal input to the pixel 50 during one horizontal period when the pixel 50 is selected.

Figure 3:
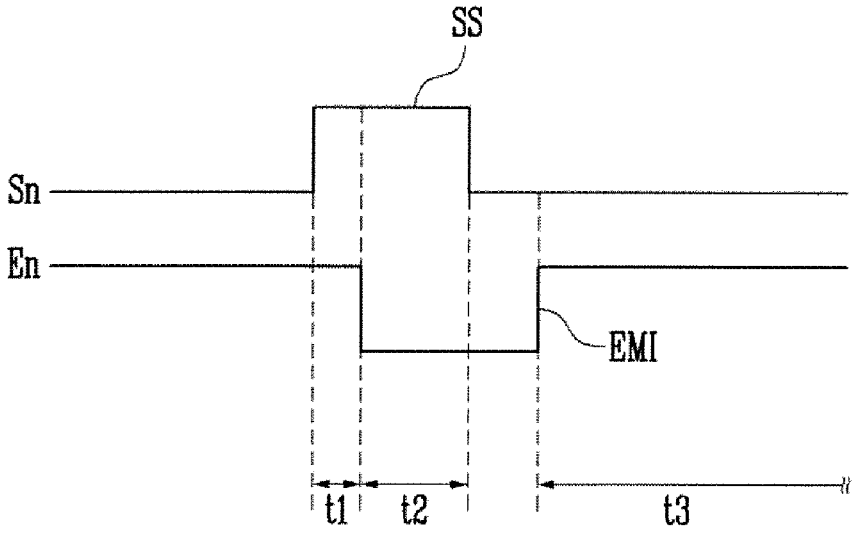
FIG. 3 is a waveform view showing a waveform of an input signal input to the pixel of FIG. 2.

Referring to FIGS. 2 and 3, the pixel 50 is initialized during a first period t1 of the scan period when a scan signal SS having a high level is supplied while an emission control signal EMI maintains a high level; programs the data signal during a second period t2 of the scan period when the scan signal SS having the high level is supplied while the emission control signal EMI having a low level is supplied; and emits light during a third period t3 when the emission control signal EMI transitioned into a high level after the supply of the scan signal SS has been suspended (i.e. a low level signal is applied to the scan line Sn) is maintained at the high level.

More specifically, during the first period t1 of the horizontal period when the pixel 50 is selected, the scan signal SS having the high level and the emission control signal EMI having the high level are supplied from the scan line Sn and the emission control line En, respectively.

During the first period t1 as described above, the first node N1 is initialized by the voltage that is transferred to the first node N1 from the first power supply ELVDD via the fifth transistor M5 and the third transistor M3 that are turned on by the emission control signal EMI and the scan signal SS, respectively. At this time, the voltage transferred from the first node N1 may be designed to be higher than the highest voltage of the gray level voltage of the data signal by the threshold voltage of the first transistor M1.

Thereafter, during the second period t2 following the first period t1, the scan signal SS having the high level and the emission control signal EMI having the low level are supplied from the scan line Sn and the emission control line En, respectively.

During the second period t2 as described above, the fourth transistor M4 and the fifth transistor M5 maintain a turn-off state by the emission control signal EMI having the low level. The second transistor M2 and the third transistor M3 maintain a turn-on state by the scan signal SS having the high level.

As the second transistor M2 maintains the turn-on state, during at least the second period t2 of the scan period, the data signal supplied to the data line Dm is transferred to the first node N1 through the first to third transistors M1 to M3.

At this time, the first transistor M1 maintains a diode-coupled state by the turn-on of the third transistor M3 so that the threshold voltage of the first transistor M1 is transferred to the first node N1, together with the voltage of the data signal. In other words, during the second period t2, the sum voltage Vdata+Vth of the voltage of the data signal (referred to as Vdata) and the threshold voltage (referred to as Vth) of the first transistor M1 is transferred to the first node N1.

Therefore, during the second period t2, the voltage $Vdata_{+}$ Vth-VSS (wherein VSS is the voltage from the second power supply ELVSS) is charged in the capacitor C1 and is maintained during the following emission period (that is, the third period t3).

Thereafter, during the third period t3 following the second period t2, the supply of the scan signal SS having the high level is suspended and the voltage level of the emission control signal EMI is transitioned again to a high level.

During the third period t3 as described above, the second transistor M2 and the third transistor M3 maintain a turn-off state, and the fourth transistor M4 and the fifth transistor M5 maintain a turn-on state.

Then, by the turn-on of the fourth transistor M4 and the fifth transistor M5, there is formed a current path through which current flows from the first power supply ELVDD to the second power supply ELVSS via the organic light emitting diode OLED, the fifth transistor M5, the first transistor M1, and the fourth transistor M4.

At this time, the voltage difference between the gate electrode and the source electrode of the first transistor M1 is maintained as Vdata+Vth-VSS that is charged by the capacitor C1 during the second period t2. Therefore, during the third period t3, the driving current which flows through the current path has the magnitude corresponding to Vdata-VSS in which the threshold voltage of the first transistor M1 is offset (i.e. compensated for). According to an exemplary embodiment, power supply lines of the second power supply ELVSS are disposed in the display unit in a mesh shape or pattern, making it possible to transfer the second power supply ELVSS uniformly to the respective pixels 50.

In exemplary embodiments of the pixel 50 as described above, the threshold voltage of the driving transistor, that is, the first transistor M1, is compensated for to display a uniform image irrespective of the variations of the threshold voltage of the driving transistors in the pixels, thereby making it possible to improve the image quality.

Also, the pixel circuit 52 of the pixel 50 as described above is made up of relatively fewer N-type transistors and does not include a separate initialization power supply, but is able to perform the initialization operation that initializes the voltage from the first node N1 by controlling the timing of each of the scan signal SS and the emission control signal EMI.

As a result, at the time of the diode-coupling that is for compensating for the threshold voltage of the driving transistor, the data signal of the current frame can be programmed stably into the pixel irrespective of the data signal of the prior frame.

Also, in exemplary embodiments of the pixel 50 as described above, the emission of the pixel 50 can be easily controlled, such as in preventing the emission of the pixel 50 by the emission control signal EMI during the data programming period and in controlling the duration of the emission period, etc. As a result, a blurring phenomenon in which a display screen is blurred may be reduced or prevented and the power consumption may also be improved.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel comprising:

an organic light emitting diode coupled between a first power supply and a second power supply having a lower voltage than the first power supply;

a first transistor coupled between the organic light emitting diode and the second power supply and having a gate electrode coupled to a first node;

a second transistor coupled between a first electrode of the first transistor and a data line and having a gate electrode coupled to a scan line;

a third transistor coupled between a second electrode of the first transistor and the first node and having a gate electrode coupled to the scan line;

a fourth transistor coupled between the first transistor and the second power supply and having a gate electrode coupled to an emission control line;

a fifth transistor coupled between the organic light emitting diode and the first transistor and having a gate electrode coupled to the emission control line; and a capacitor coupled between the first node and the second power supply, wherein the first, second, third, fourth, and fifth transistors are N-type transistors.

2. The pixel as claimed in claim 1, wherein the pixel is configured to receive a scan signal having a high level from the scan line and an emission control signal having a high level from the emission control line during a first period of a horizontal period when the pixel is selected, the pixel is further configured to receive the scan signal having the high level and an emission control signal having a low level during a second period following the first period, and the pixel is further configured to receive the emission control signal having the high level during a third period in which a supply of the scan signal having the high level to the pixel is suspended, the third period following the second period.

3. The pixel as claimed in claim 2, wherein during the first period, the first node is initialized by a voltage transferred to the first node from the first power supply via the fifth transistor and the third transistor.

4. The pixel as claimed in claim 2, wherein during the second period, a data signal supplied from the data line is transferred to the first node through the first, second, and third transistors.

5. The pixel as claimed in claim 4, wherein during the second period, the first transistor maintains a diode-coupled state by turn-on of the third transistor.

6. The pixel as claimed in claim 2, wherein during the third period, a current path through which current flows to the second power supply from the first power supply via the organic light emitting diode is formed by turn-on of the fourth and fifth transistors.

7. The pixel as claimed in claim 1, wherein the first electrode of the first transistor is a source electrode and the second electrode of the first transistor is a drain electrode.

8. An organic light emitting display device comprising a display unit comprising a plurality of pixels, each of the pixels comprising:

an organic light emitting diode coupled between a first power supply and a second power supply having a lower voltage than the first power supply;

a first transistor coupled between the organic light emitting diode and the second power supply and having a gate electrode coupled to a first node;

a second transistor coupled between a first electrode of the first transistor and a data line and having a gate electrode coupled to a scan line;

a third transistor coupled between a second electrode of the first transistor and the first node and having a gate electrode coupled to the scan line;

a fourth transistor coupled between the first transistor and the second power supply and having a gate electrode coupled to an emission control line;

a fifth transistor coupled between the organic light emitting diode and the first transistor and having a gate electrode coupled to the emission control line; and a capacitor coupled between the first node and the second power supply.

9. The organic light emitting display device as claimed in claim 8, wherein the first, second, third, fourth, and fifth transistors are N-type transistors.

10. The organic light emitting display device as claimed in claim 8, further comprising a scan driver configured to provide to pixels of the plurality of pixels: a scan signal having a high level and an emission control signal having a high level during a first period of a horizontal period when the pixels are selected; the scan signal having the high level and an emission control signal having a low level during a second period following the first period; and the emission control signal having the high level during a third period in which a supply of the scan signal having the high level to the pixels is suspended, the third period following the second period.

11. The organic light emitting display device as claimed in claim 8, wherein the first electrode of the first transistor is a source electrode and the second electrode of the first transistor is a drain electrode.

12. The organic light emitting display device as claimed in claim 8, wherein the display unit further comprises power supply lines for supplying a second power from the second power supply, the power supply lines arranged in a mesh pattern.

13. A method of controlling a pixel having an organic light emitting diode coupled between a first power supply and a second power supply having a lower voltage than the first power supply; a first transistor coupled between the organic light emitting diode and the second power supply and having a gate electrode coupled to a first node; a second transistor coupled between a first electrode of the first transistor and a data line and having a gate electrode coupled to a scan line; a third transistor coupled between a second electrode of the first transistor and the first node and having a gate electrode coupled to the scan line; a fourth transistor coupled between the first transistor and the second power supply and having a gate electrode coupled to an emission control line; a fifth transistor coupled between the organic light emitting diode and the first transistor and having a gate electrode coupled to the emission control line; and a capacitor coupled between the first node and the second power supply, the method comprising:

supplying to the pixel a scan signal having a high level from the scan line and an emission control signal having a high level from the emission control line during a first period of a horizontal period when the pixel is selected;

supplying to the pixel the scan signal having the high level and an emission control signal having a low level during a second period following the first period;

suspending the scan signal having the high level to the pixel after the second period; and supplying to the pixel the emission control signal having the high level during a third period subsequent to suspending the supply to the pixel of the scan signal having the high level.

14. The method as claimed in claim 13, wherein the first node is initialized during the first period by a voltage transferred to the first node from the first power supply via the fifth transistor and the third transistor.

15. The method as claimed in claim 13, further comprising supplying a data signal from the data line during the second period, wherein the data signal is transferred to the first node through the first, second, and third transistors.

16. The method as claimed in claim 15, wherein a diode-coupled state of the first transistor is maintained during the second period by turn-on of the third transistor.

17. The method as claimed in claim 13, wherein a current path through which current flows from the first power supply to the second power supply via the organic light emitting diode is formed during the third period by turn-on of the fourth and fifth transistors.

* * * * *